US006669899B2

(12) United States Patent
Bae et al.

(10) Patent No.: US 6,669,899 B2
(45) Date of Patent: Dec. 30, 2003

(54) DUCTILE PARTICLE-REINFORCED AMORPHOUS MATRIX COMPOSITE AND METHOD FOR MANUFACTURING THE SAME

(75) Inventors: Dong Hyun Bae, Seoul (KR); Min Ha Lee, Seoul (KR); Jin Kyu Lee, Koyang-si (KR); Do Hyang Kim, Seoul (KR); Won Tae Kim, Seoul (KR); Daniel J. Sordelet, Ames, IA (US)

(73) Assignee: Yonsei University, Seoul (KR)

( * ) Notice: Subject to any disclaimer, the term of this patent is extended or adjusted under 35 U.S.C. 154(b) by 0 days.

(21) Appl. No.: 10/054,866

(22) Filed: Jan. 25, 2002

(65) Prior Publication Data

US 2003/0140987 A1 Jul. 31, 2003

(51) Int. Cl.[7] ..... B22F 3/20; B22F 3/12; B22F 1/00

(52) U.S. Cl. ..... 419/38; 419/23; 419/41

(58) Field of Search ..... 419/28, 23, 38, 419/41

(56) References Cited

U.S. PATENT DOCUMENTS 4,377,622 A * 3/1983 Liebermann ..... 428/605
4,594,104 A * 6/1986 Reybould ..... 75/243
4,921,410 A * 5/1990 Kawamura et al. ..... 419/8
5,262,123 A * 11/1993 Thomas et al. ..... 419/67
5,306,463 A * 4/1994 Horimura ..... 419/44
5,342,575 A * 8/1994 Nagai ..... 419/67
5,509,975 A * 4/1996 Kojima et al. ..... 148/104
5,851,317 A * 12/1998 Biner et al. ..... 148/403
6,274,082 B1 * 8/2001 Nagahora et al. ..... 419/5

* cited by examiner

*Primary Examiner*—Daniel J. Jenkins
(74) *Attorney, Agent, or Firm*—Rosenberg, Klein & Lee

(57) ABSTRACT

A ductile particle-reinforced amorphous matrix composite characterized in that ductile powder is dispersed into amorphous matrix and the mixture is plastically worked to be consolidated and a method for manufacturing the same are provided. The amorphous powder includes any alloy, which can be produced in the form of amorphous structure and which is selected from the group consisting of Ni-, Ti-, Zr-, Al-, Fe-, La-, Cu- and Mg-based alloys. The method for manufacturing a ductile particle-reinforced amorphous matrix composite, the method comprising steps of preparing a mixture consisting of amorphous powder and ductile powder, obtaining a billet by compacting the mixture in a hermetically sealing condition, and plastic working the mixture by processing the billet at the temperature in the super-cooled liquid region of the amorphous alloy.

5 Claims, 7 Drawing Sheets

DUCTILE PARTICLE-REINFORCED AMORPHOUS MATRIX COMPOSITE AND METHOD FOR MANUFACTURING THE SAME

BACKGROUND OF THE INVENTION

1. Field of the Invention

The present invention relates to a ductile particle-reinforced amorphous matrix composite and a method for manufacturing the same. This composite includes a mixture consisting of an amorphous phase powder and a ductile metallic powder dispersed into the amorphous phase powder.

The mixture is plastically worked by a hot extrusion or a hot forging, and is thereby consolidated. The consolidated products contain small amount of micro-voids and show enhanced inelastic elongation and fracture toughness, compared to those of the monolithic. Further, with this composite structure, the amorphous material can be fabricated to be bigger and versatile in size, thereby manufacturing large-sized products with high quality and high strength.

2. Description of the Related Art

Usually, amorphous materials exhibit high mechanical strength at temperature below a glass transition temperature. For example, Ni-, Ti- or Zr-based amorphous alloy shows the level of fracture strength approximately 2 GPa, and Al-based amorphous alloys show that around 1 GPa. This high fracture strength mainly results from a unique atomic structure of the amorphous material. Therefore, the amorphous material has a great potential in useful engineering applications.

However, the above-mentioned alloys having an excellent glass forming ability are limited in size to be produced. That is, in producing by solidifying the molten alloy into a solid state, the structure of these alloys becomes to be amorphous in a comparatively low cooling rate condition such as 1–250 K/s. However, a maximum size with the amorphous structure attainable by this method is around 10 mm in diameter. Further, the amorphous material shows little inelastic ductility below the glass transition temperature. Although the amorphous material has some plasticity, it deforms with the formation of shear band and strain-hardening behavior does not occur during deformation, then being catastrophically failed. (A. Inoue, Prog. Mat. Sci., 43, (1998), 365)

In order to overcome one of the problems of this size limit, U.S. Pat. No. 4,523,621 discloses a method for making amorphous powder and consolidating this powder by a hot extrusion. Powders are made by a gas atomization method under the rapid solidification condition. Amorphous powder selected from them is contained in a Cu container and sealed. Then, the amorphous powder is consolidated beyond the amorphous transition temperature by a hot extrusion or a hot forging to obtain a bulk amorphous material without size limitation.

In this '621 method, it is sometimes difficult to consolidate the powder under the condition of maintaining the vitreous state. That is, in order to prevent crystallization in the amorphous alloy, extrusion ratio needs to be reduced. Furthermore, an oxide layer generally formed on the surface of the amorphous powders can reduce the bonding strength between the amorphous powders. Due to these disadvantages mentioned above, the product contains micro-voids between the particles.

In order to prevent the formation of the oxide layer, the entire fabrication processes should be carried out under an Ar gas or vacuum condition, thereby increasing the production cost. Further, after extrusion, the produced sample should be rapidly cooled to prevent crystallization.

In general, the amorphous materials show a catastrophic failure without inelastic deformation. Therefore, there requires a need for making a material for preventing the crack propagation.

In order to solve this fracture toughness problem, various ways have been introduced. For example, there are an amorphous matrix composite made by adding metal powder into a molten alloy and rapidly solidifying the mixture (R. D. Conner, R. B. Dandliker and W. L. Johnson, Acta Mater., 46 (1998) 6089), a composite made by penetrating a molten alloy into dispersing tungsten wires and cooling the mixture (U.S. Pat. No. 6,010,580) and a composite, on which a ductile phase is first formed by controlling the solidification route then the other becomes an amorphous phase (C. C. Hays, C. P. Kim and W. L. Johnson, Proc. ISMANAM. ISMANAM-99, Mater. Sci. Forum, Dresden, Germany, 2000). All these cases relatively improve inelastic elongation, but form amorphous phase at the time of solidification of the molten alloy, thereby limiting the produced size.

SUMMARY OF THE INVENTION

Accordingly, an object of the present invention is to improve the above-described conventional problems such as size and/or shape limit and fracture toughness.

Another object of the present invention is to provide a composite, in which ductile metallic particles are dispersed in an amorphous matrix, and a method for manufacturing the same. Herein, the composite is manufactured by mixing ductile powder and amorphous powder in a predetermined volume fraction of ductile powder and extruding or forging the mixture beyond the amorphous transition temperature and below the crystallization temperature (i.e., in the range of super-cooled liquid region). Thereby, both the amorphous powder and the ductile powder are plastically deformed and consolidated each other.

In order to achieve the foregoing and other objects, the present invention provides a ductile particle-reinforced amorphous matrix composite characterized in that a ductile powder is dispersed in an amorphous matrix made by an amorphous powder.

The amorphous powder includes one alloy powder which can be produced in the form of amorphous phase, for example, Ni-, Ti-, Zr-, Al-, Fe-, La-, Cu- or Mg-based alloy.

The ductile powder includes any metallic alloy with a flow stress lower than that of the amorphous powder during the fabrication in the super-cooled liquid region.

In the super-cooled liquid region, the amorphous material deforms via viscous flow and the ductile powder is strained more than that of the amorphous material.

Herein, the level of stress of the ductile powder should be lower than that of the amorphous powder. In case of using the ductile powder with higher stress, the ductile powder is not deformed and remains with an initial shape, or is strained less than the amorphous powder, thereby reducing the interfacial bonding strength between the ductile particles and the amorphous particles or forming micro-voids between the interfaces. This deteriorates the mechanical properties of the composite.

The content of the ductile powder is designated as a predetermined range for improving inelastic elongation without significantly losing the strength of the composite, compared to that of the material including only the amorphous powder.

In order to obtain this object, the ductile powder is preferably 0.1 vol % through 40 vol %.

Since the ductile powder with a content of more than 50 vol % makes the composite the ductile matrix, the ductile powder is contained in less than 50 vol %.

Usually, if the ductile powder is more than 30 vol %, the aggregation among the ductile particles occurs. Therefore, the added ductile particles should be isolated from each other and dispersed randomly into the amorphous powder.

However, the upper limit of the ductile powder of the present invention is 40 vol %. As shown in FIG. 5, the ductile powder with a content of 30 vol % does not particularly show the aggregation. Further, the lower limit of the ductile powder of the present invention is 0.1%. The ductile powder with content less than 0.1 vol % does not provide our objectives.

Further, since the ductile powder is selected from any material with a stress lower than that of the amorphous powder in the super-cooled region during the fabrication, the ductile powder is not limited in an particle shape, i.e., fiber or spherical shape and in an particle size.

In another aspect of the present invention, a method for manufacturing a ductile particle-reinforced amorphous matrix composite is provided. The method comprises steps of preparing a mixture consisting of amorphous powder and ductile powder; obtaining a billet by compacting said mixture in a hermetically sealing condition; and plastic working the billet at a super-cooled liquid temperature range of the amorphous powder.

The billets are plastically worked by a hot extrusion or a hot forging. Herein, the amorphous particles do not transform to be crystallized and remain the amorphous phase.

The amorphous matrix composite is manufactured as a final product by mechanically machining, electric discharge machining or forming at the super-cooled liquid temperature.

The amorphous matrix composite manufactured according to the present invention includes ductile powder, thereby reducing the formation of micro-voids which are generated in the conventional method for the material including only the amorphous particles. Since the ductile powder serves as a barrier for propagating the shear band or crack as well as a starting point of the shear band formation, the composite of the present invention provides the improved inelastic elongation and fracture toughness at a room temperature.

BRIEF DESCRIPTION OF THE DRAWINGS

These and other objects, features and advantages of the present invention will be readily understood with reference to the following detailed descriptions thereof provided in conjunction with the accompanying drawings, wherein like reference numerals designate like structural elements, and, in which.

DETAILED DESCRIPTION OF THE PREFERRED EMBODIMENTS

Preferred embodiments of the present invention will be described below with reference to the accompanying drawings.

EXAMPLES 1 THROUGH 3

A Ni-based alloy with an excellent glass forming ability ($Ni_{59}Zr_{20}Ti_{16}Si_2Sn_3$, atomic %) is arc-melted in an induction furnace under Ar atmosphere and solidified to manufacture a mother alloy. The mother alloy is again melted in a gas atomization furnace and produced in the form of powder through a nozzle with a diameter of 3.2 mm. Herein, pressure is approximately 2.8 MPa and temperature of the molten metal is about 1,623 K. Particles of the powder vary in size from below 10 $\mu$m to beyond 150 $\mu$m, and are sorted at intervals of approximately 10 $\mu$m.

Figure 1:
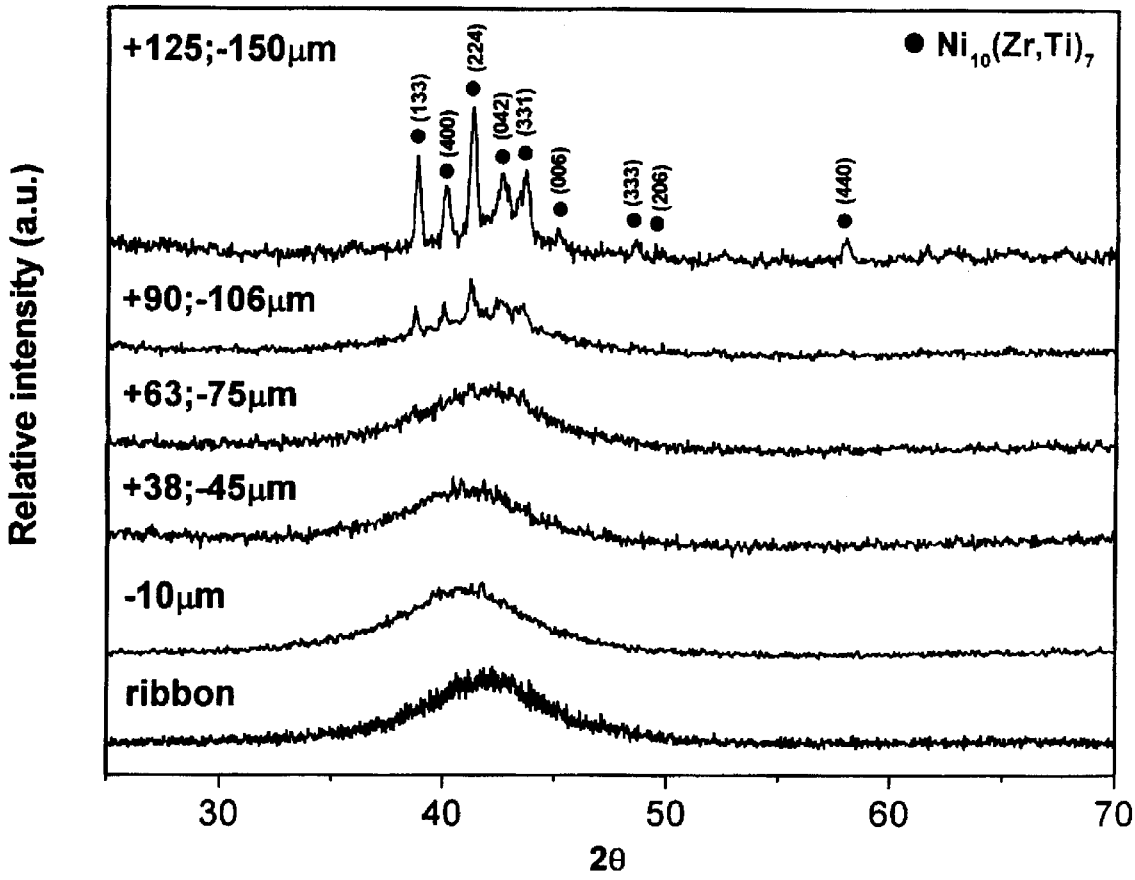
FIG. 1 is an X-ray diffraction patterns for amorphous particles with diameters of 10, 45, 75, 106, and 150 $\mu$m and a ribbon fabricated by the rapidly solidified condition.

FIG. 1 shows X-ray diffraction patterns of amorphous particles with a diameter of 10, 45, 75, 106, and 150 $\mu$m obtained from the above-described $Ni_{59}Zr_{20}Ti_{16}Si_2Sn_3$ alloy and a ribbon fabricated with higher cooling rate. From this graph, it is known that particles with a diameter of more than 75 $\mu$m are crystallized. Therefore, subsequent tests use only particles with a diameter of less than 75 $\mu$m.

Figure 2:
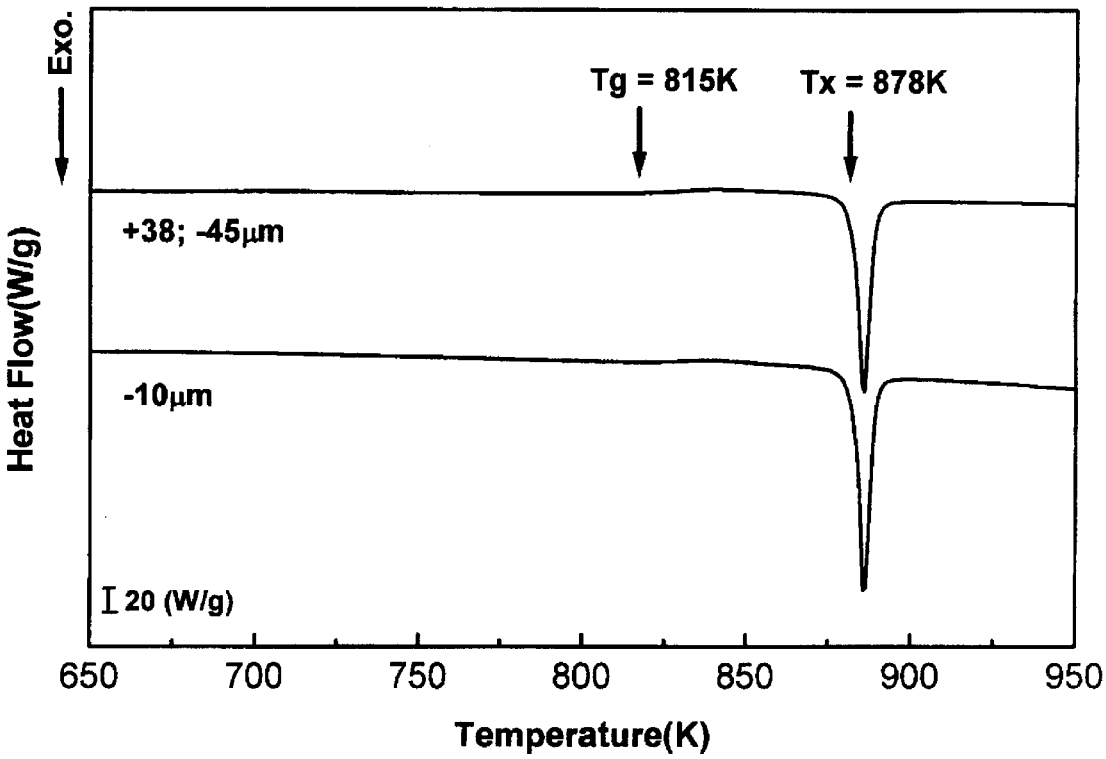
FIG. 2 is a graph showing thermal property of the amorphous particles with a diameter of 10 and 45 $\mu$m obtained using differential scanning calorimeter (DSC) at a heating rate of 30 K/min.

FIG. 2 is a graph showing thermal characteristic of the amorphous particles with a diameter of 10 $\mu$m and 45 $\mu$m. Herein, the graph is obtained by continuously heating the particles at a heating rate of 30 K/min using a differential scanning calorimeter (DSC). As noted by this graph, the glass transition temperature (Tg) is 815K and the crystallization temperature (Tx) is 878 K. Therefore, a temperature range for plastic working the powder is between these two temperatures, that is, a super-cooled liquid temperature of 848 K. At this temperature, in case that extrusion ram speed is 0.48 cm/sec, the applied stress of only the amorphous powder is around 500 MPa.

Meanwhile, the ductile powder is Cu particles with the flow stress much lower than that of the amorphous powder. The Cu powder with a similar diameter to the amorphous particle is added into and uniformly mixed with the amorphous powder by the content of 10 vol %, 20 vol % and 30 vol %, respectively, thereby preparing mixtures of examples 1, 2 and 3. Then, Cu tubes with an inside diameter of 125 mm are respectively filled with the mixtures of the examples 1, 2 and 3, and compacted by providing pressure at room temperature in a hermetically sealing condition, thereby obtaining 3 billets. The billets are rapidly heated up to an extrusion temperature of 848 K, and extruded at a ram speed of 0.48 cm/sec under a condition of an extrusion ratio 5. Then, the billets are cooled down in the air, thereby manufacturing samples 1, 2, and 3. Each of the manufactured samples of the amorphous matrix composite has a diameter of 25 mm and a length of 100 mm.

Figure 3A:
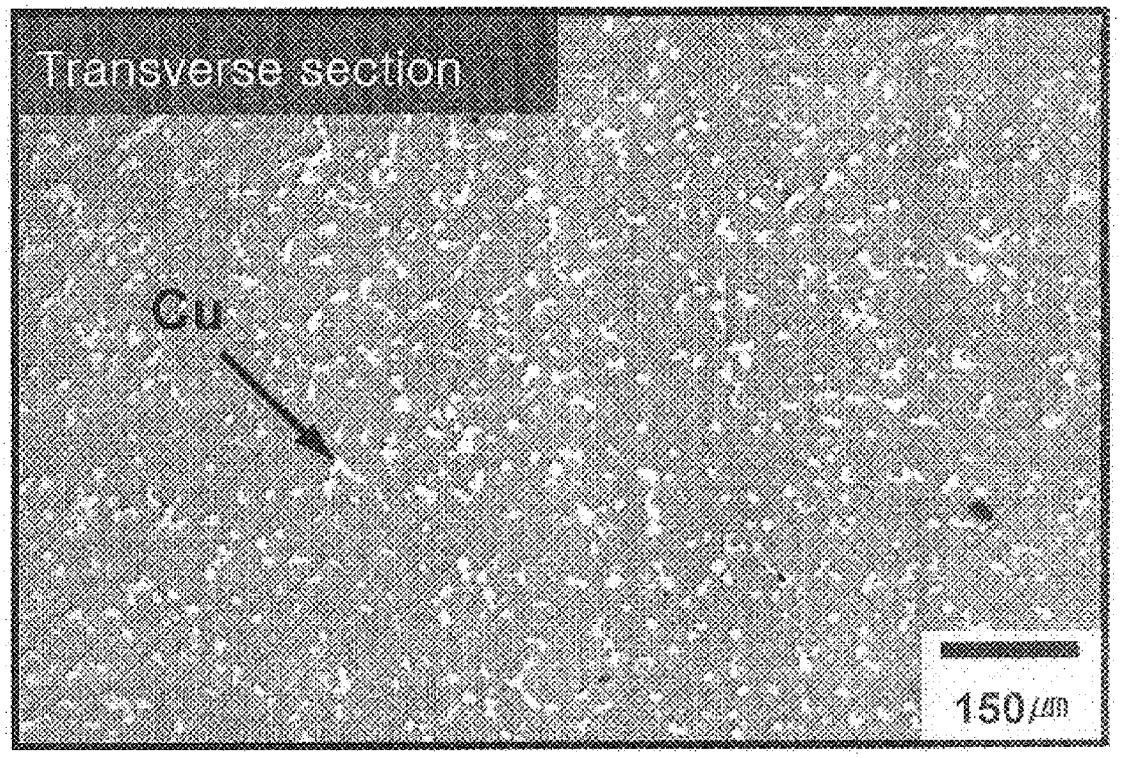
FIGS. 3*a* and 3*b* are photographs respectively showing a transversal and longitudinal section of an amorphous matrix composite of an example 1 containing Cu particles in a content of 10 vol %.
Figure 3B:
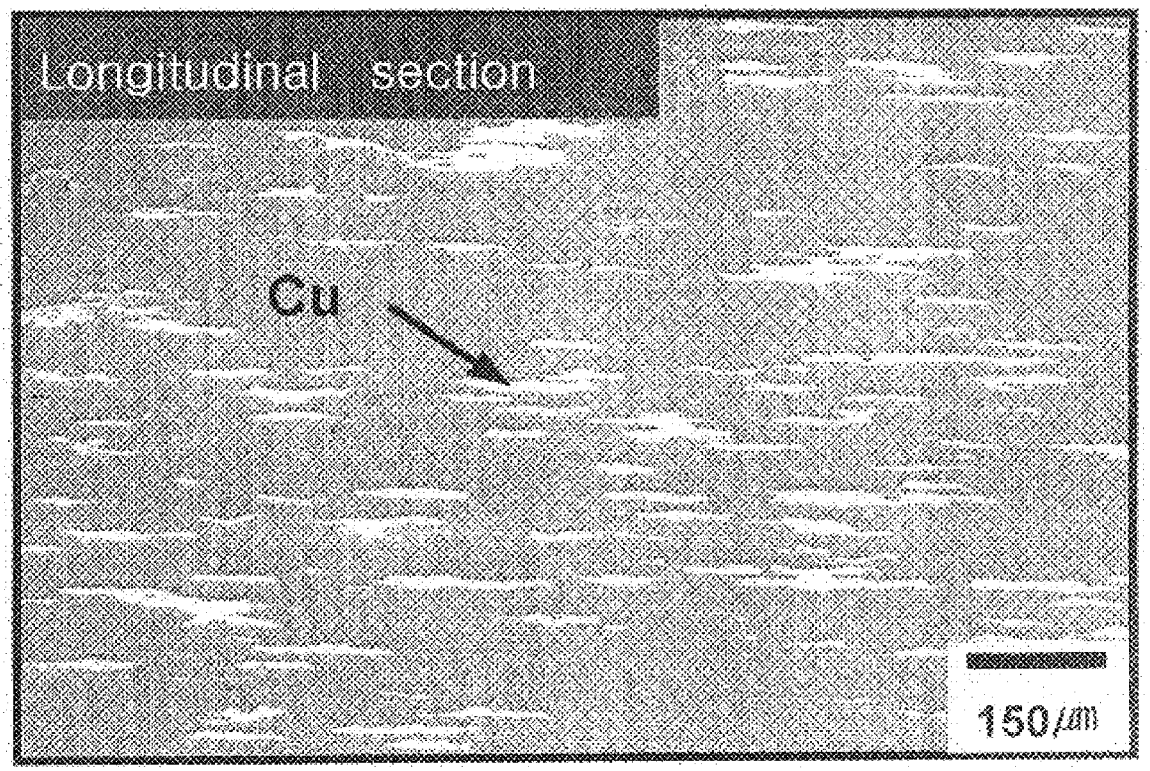

FIGS. 3*a* and 3*b* are photographs respectively showing a transversal and longitudinal section of an amorphous matrix composite sample of an example 1 containing Cu particle in the content of 10 vol %. Referring to FIG. 3*a*, the Cu particles are uniformly dispersed into the amorphous matrix. Referring to FIG. 3*b*, the Cu particles with an initially spherical shape are elongated along the longitudinal direction.

Figure 4:
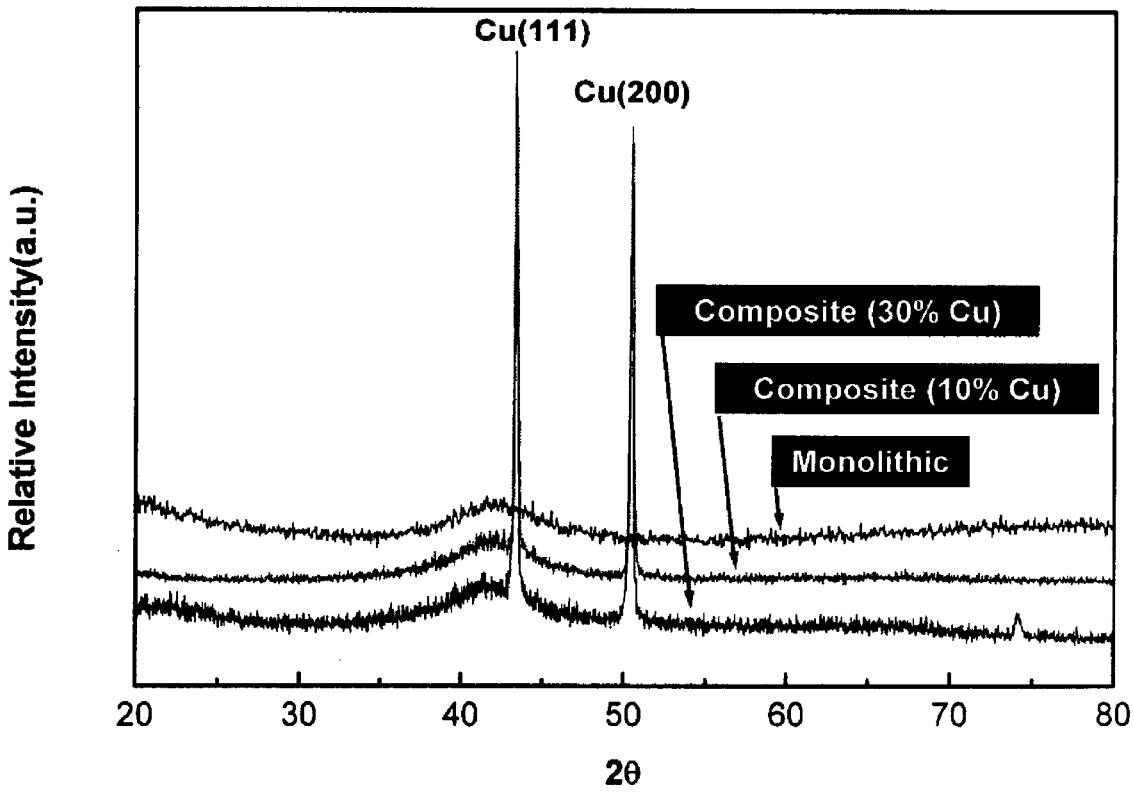
FIG. 4 is an X-ray diffraction patterns for a composite of the example 1 containing Cu particle in content of 10 vol % and a composite of an example 3 containing Cu particle in a content of 30 vol %.

FIG. 4 is an X-ray diffraction patterns for a composite sample of the example 1 containing Cu particles in content of 10 vol % and a composite sample of an example 3 containing Cu particles in content of 30 vol %. As shown in FIG. 4, other crystalline phases except for the Cu metal does not appear, thereby maintaining the amorphous phase. Herein, "Monolithic" represents a matrix including only the amorphous phase powder. The composite sample of the example 2 is the same as the above-described samples of the examples 1 and 3.

Figure 5:
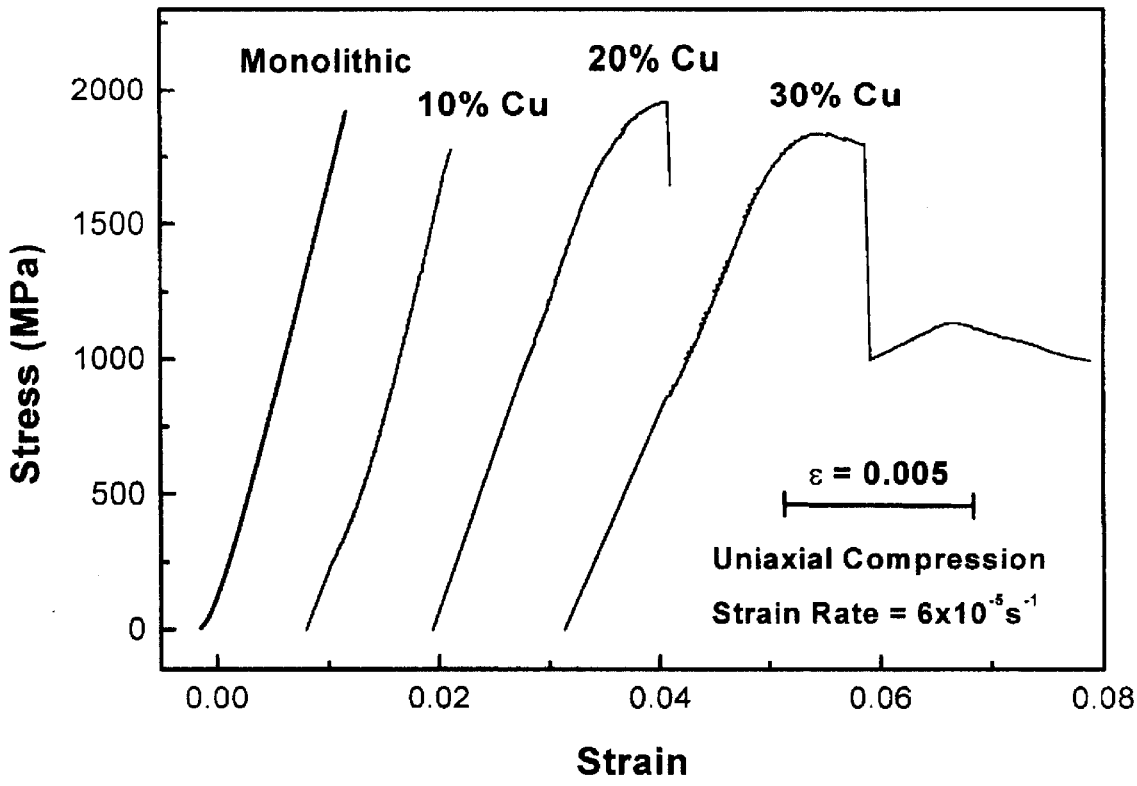
FIG. 5 is a graph showing the stress-strain relationships for composites of example 1, 2 and 3 tested under the quasi-static uni-axial compression condition.

FIG. 5 is the stress vs. strain relationships for the composite samples of the examples 1, 2 and 3 obtained from the uni-axial compression condition. Also, "Monolithic" represents a matrix including only the amorphous powder. The monolithic shows yield stress of approximately 2.0 GPa, which is almost similar to that of the as-cast amorphous sample, i.e., 2.2 GPa.

Referring to FIG. 5, as the content of Cu particles increases, the yield stress of the composite somewhat decreases, while the inelastic elongation increases. The plastic deformation, that is, the increase of the elongation is a significant factor, which makes the amorphous material to be useful as a structural member having higher fracture toughness. In general, the conventional amorphous material made by the warm extrusion of the amorphous powder does not exhibit this property. Without the plastic deformation, it is impossible to predict the condition of facture or breakdown of the material. Therefore, the conventional amorphous material without the plastic deformation cannot be used as a structural application.

However, the present invention includes a ductile metallic powder within the high-strength amorphous material. Since this ductile metallic powder serves as a barrier for propagating the shear band as well as a starting point of the formation of shear band, the composites plastically deform with multiple shear bands, improving the fracture toughness.

Figure 6:
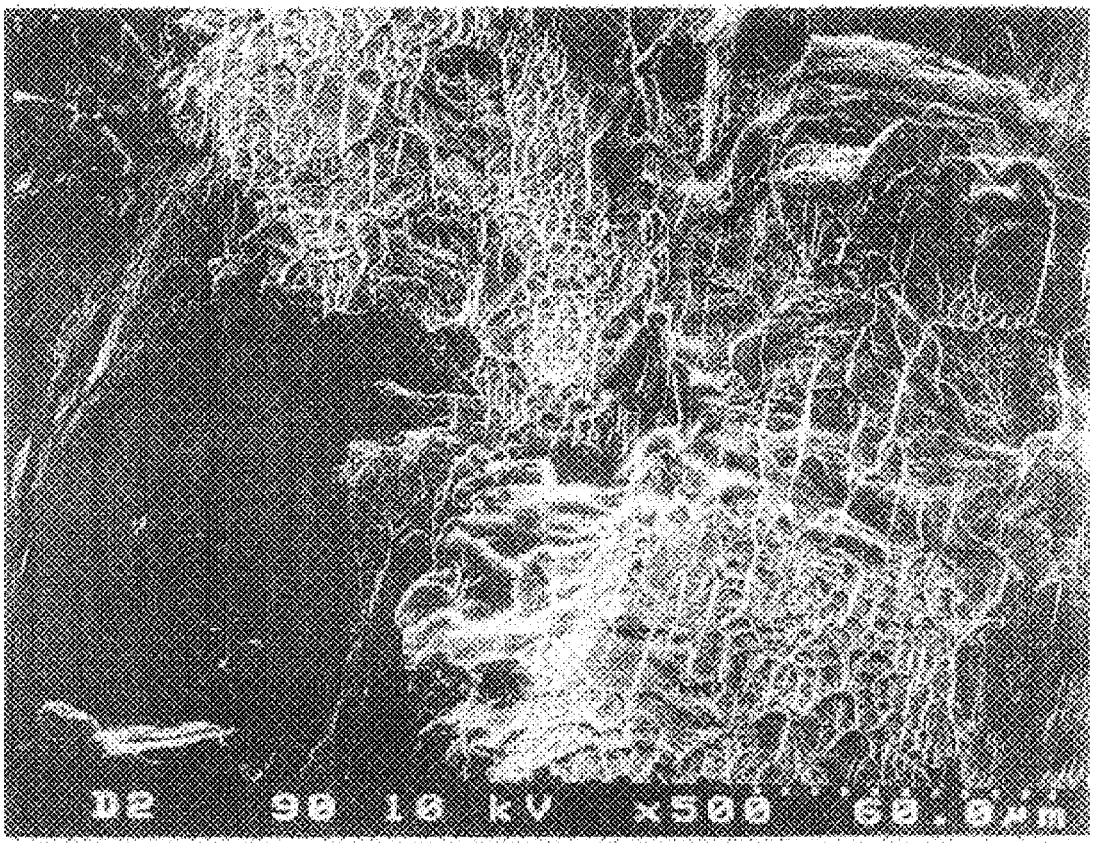
FIG. 6 is a SEM photograph showing a fractured surface of a composite in accordance with the present invention.

FIG. 6 is a SEM photograph showing a fractured surface of a composite sample in accordance with the present invention. FIG. 6 shows a fracture characteristic of the amorphous material, i.e., vein pattern, on several locations. That is, both ductile fracture and brittle facture occur in the composite of the present invention.

Although the above-described preferred embodiments of the present invention describes a Ni-based alloy, since the composite of the present invention is manufactured via viscous flow of the amorphous phase at the temperature in the super-cooled liquid region, the present invention may employ any other alloys including the Ni-based alloy.

Accordingly, the present invention provides a composite with various size manufactured by dispersing the ductile particles into the amorphous matrix and plastic working the mixture by a hot extrusion or a hot forging method, thereby overcoming the conventional size limit, which is resulted from rapid solidification of the molten alloy.

Moreover, since the addition of the ductile particles improves toughness of the amorphous material without any reduction of the strength, the amorphous matrix composite of the present invention is useful as a structural member with high strength and high quality.

Although the preferred embodiments of the present invention have been described in detail hereinabove, it should be understood that many variations and/or modifications of the basic inventive concepts herein taught which may appear to those skilled in the art will still fall within the spirit and scope of the present invention as defined in the appended claims.

What is claimed is:

1. A method for manufacturing a ductile particle-reinforced amorphous matrix composite in which ductile metallic particles are dispersed in an amorphous matrix, said method comprising steps of:

preparing a mixture consisting of amorphous powder and 0.1–40 vol % of ductile metallic powder uniformly dispersed therein having a flow stress lower than that of the amorphous powder during fabrication in a super-cooled liquid region of the amorphous powder;

obtaining a billet by compacting said mixture in a hermetically sealing condition; and plastic working the billet at a temperature in the super-cooled liquid region of the amorphous powder to obtain the ductile particle-reinforced amorphous matrix composite in which ductile metallic particles are dispersed in the amorphous matrix.

2. The method as defined in claim 1, wherein said amorphous powder includes any one alloy powder which can be produced in the form of an amorphous structure.

3. The method as defined in claim 2, wherein said alloy is one selected from the group consisting of Ni-, Ti-, Zr-, Fe-, La-, Cu- and Mg-based alloy.

4. The method as defined in claim 1, wherein said plastic working is carried out by a hot extrusion or a hot forging.

5. The method as defined in claim 1, wherein said step of preparing a mixture includes the step of providing said amorphous powder and ductile metallic powder with a particle size less than 75 $\mu$m.

* * * * *